US007828058B2

(12) United States Patent
Fielder

(10) Patent No.: US 7,828,058 B2
(45) Date of Patent: Nov. 9, 2010

(54) MONITORING AND AUTOMATIC CONTROL OF OPERATING PARAMETERS FOR A DOWNHOLE OIL/WATER SEPARATION SYSTEM

(75) Inventor: Lance Fielder, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 341 days.

(21) Appl. No.: 11/691,877

(22) Filed: Mar. 27, 2007

(65) Prior Publication Data

US 2008/0236821 A1 Oct. 2, 2008

(51) Int. Cl.
*E21B 43/12* (2006.01)

(52) U.S. Cl. ..... 166/250.15; 166/105

(58) Field of Classification Search ..... 166/250.01, 166/250.15, 265, 53, 105
See application file for complete search history.

(56) References Cited

U.S. PATENT DOCUMENTS

| | | | | | |
|---|---|---|---|---|---|
| 4,685,522 | A * | 8/1987 | Dixon et al. | 166/372 |
| 4,770,243 | A * | 9/1988 | Fouillout et al. | 166/53 |
| 4,805,697 | A * | 2/1989 | Fouillout et al. | 166/265 |
| 5,711,374 | A * | 1/1998 | Kjos | 166/265 |
| 5,730,871 | A * | 3/1998 | Kennedy et al. | 166/265 |
| 5,941,305 | A * | 8/1999 | Thrasher et al. | 166/53 |
| 5,959,547 | A | 9/1999 | Tubel | |
| 5,996,690 | A | 12/1999 | Shaw | |
| 6,000,468 | A * | 12/1999 | Pringle | 166/53 |
| 6,017,456 | A * | 1/2000 | Kennedy et al. | 166/265 |
| 6,033,567 | A * | 3/2000 | Lee et al. | 166/265 |
| 6,167,965 | B1 | 1/2001 | Bearden | |
| 6,189,613 | B1 * | 2/2001 | Chachula et al. | 166/265 |
| 6,196,310 | B1 * | 3/2001 | Knight | 166/105.5 |
| 6,367,547 | B1 * | 4/2002 | Towers et al. | 166/265 |
| 6,415,864 | B1 | 7/2002 | Ramakrishnan | |
| 6,513,594 | B1 | 2/2003 | McCalvin | |
| 6,550,535 | B1 * | 4/2003 | Traylor | 166/265 |
| 2004/0104027 | A1 * | 6/2004 | Rossi et al. | 166/250.15 |
| 2004/0262008 | A1 | 12/2004 | Deans | |
| 2009/0056939 | A1 * | 3/2009 | Hackworth et al. | 166/265 |

FOREIGN PATENT DOCUMENTS

| | | | |
|---|---|---|---|
| GB | 2317406 | A | 3/1998 |
| GB | 2369631 | A | 6/2002 |
| GB | 2406238 | A | 3/2005 |
| GB | 2416097 | A | 1/2006 |
| GB | 2423207 | A | 8/2006 |
| WO | 9708459 | A1 | 3/1997 |
| WO | 98/37307 | A1 | 8/1998 |

* cited by examiner

*Primary Examiner*—Kenneth Thompson
*Assistant Examiner*—Blake Michener

(57) ABSTRACT

A method for operating a downhole oil water separator and electric submersible pump includes measuring fluid pressure proximate one of the pump intake, separator intake and a bottom of a wellbore. At least one of flow rate and pressure is measured at the separator water outlet. Pump and a water outlet restriction are controlled to maintain an optimum fluid pumping rate and an optimum injection rate of separated water. A flow control system includes a controllable valve disposed in a water outlet of the separator. At least one of a pressure sensor and a flowmeter is operatively coupled to the water outlet. A controller is in signal communication with the at least one of a pressure sensor and flowmeter and in operative communication with the valve. The controller operates the valve to maintain at a selected pressure and/or a selected flow rate through the water outlet.

3 Claims, 3 Drawing Sheets

MONITORING AND AUTOMATIC CONTROL OF OPERATING PARAMETERS FOR A DOWNHOLE OIL/WATER SEPARATION SYSTEM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates generally to the field of downhole oil/water separation systems. More specifically, the invention relates to automatic operation of a downhole oil/water separation system to maintain preferred system operating parameters.

2. Background Art

Hydrocarbon production systems known in the art include combinations of electric submersible pump ("ESP") and downhole oil water separator ("DOWS"). In an ESP/DOWS production system, the ESP and DOWS are disposed in a wellbore drilled through subsurface formations. The wellbore typically has a steel pipe or casing disposed therein extending from the Earth's surface to a depth below the deepest subsurface formation from which fluid is to be withdrawn or injected.

The ESP is typically a centrifugal pump rotated by an electric motor. The intake of the ESP is in hydraulic communication with one or more of the subsurface formations from which fluid is withdrawn (the "producing formation" or "producing zone"). The ESP outlet or discharge is in hydraulic communication with the inlet of the DOWS. The DOWS has two outlets, one for water separated from the fluid withdrawn from the producing formation and the other outlet for the fluid remaining after water separation. Typically, the separated water outlet is in hydraulic communication with one or more of the subsurface formations that are used to disposed of the separated water (the "injection formation" or "injection zone").

The DOWS is typically a hydrocyclone separator or a centrifuge-type separator. A hydrocyclone separator includes devices that cause the fluid flowing therein to move in rotational path at high speed, so as to cause the more dense water to move toward the radially outermost portion of the separator. The less dense fluid, consisting primarily of oil, is constrained to move generally along the radial center of the separator. A centrifuge separator is typically operated by a motor, which may be the same or different motor than the one that drives the ESP. Devices in the centrifuge use the rotational energy of the motor to cause the fluids entering the centrifuge to rotate at high speed, whereupon the water and oil are constrained in a manner similar to that of a hydrocyclone separator.

In order to obtain the most benefit from an ESP/DOWS production system, it is desirable to operate the ESP so that the amount of fluid moving through the ESP/DOWS system is equal to the rate at which the producing formation can produce the fluid. It is also desirable to control operation of the DOWS such that the amount of fluid injected into the injection formation is not more than the injection formation can accept, or, alternatively, that the fluid flow rate through the DOWS does not exceed the separation capacity of thereof. In the latter case oil may be discharged through the water outlet and disposed of in the injection formation.

It is known in the art to automatically control the operating rate of the ESP to cause the ESP to move a suitable amount of fluid. See, for example, U.S. Pat. No. 5,996,690 issued to Shaw et al. The system disclosed in the Shaw et al. '690 patent does not provide for any control over the fluid output from the DOWS or any separate control over the rate of fluid discharged from the water outlet of the DOWS.

SUMMARY OF THE INVENTION

One aspect of the invention is a method for operating a downhole oil water separator and electric submersible pump in a wellbore. A method according to this aspect of the invention includes measuring fluid pressure proximate at least one of an intake of the pump, and intake of the separator and a bottom of the wellbore. At least one of flow rate and pressure is measured at a water outlet of the separator. Speed of the pump and a restriction in the water outlet are controlled to maintain an optimum fluid pumping rate and an optimum injection rate of separated water into an injection formation.

A flow control system for use with an electric submersible pump and downhole oil water separator disposed in a wellbore according to another aspect of the invention includes a controllable valve disposed in a water outlet of the separator. At least one of a pressure sensor and a flowmeter is operatively coupled to the water outlet. A controller is in signal communication with the at least one of a pressure sensor and flowmeter and in operative communication with the valve. The controller is configured to operate the valve to maintain at least one of a selected pressure and a selected flow rate through the water outlet.

A method for operating a downhole oil water separator and electric submersible pump in a wellbore according to another aspect of the invention includes measuring a parameter related to presence of oil in a water outlet of the separator, and reducing an amount of water flow from a water outlet of the separator to an injection formation if the measured oil parameter indicates presence of oil in the separated water.

Other aspects and advantages of the invention will be apparent from the following description and the appended claims.

DETAILED DESCRIPTION

Figure 1:
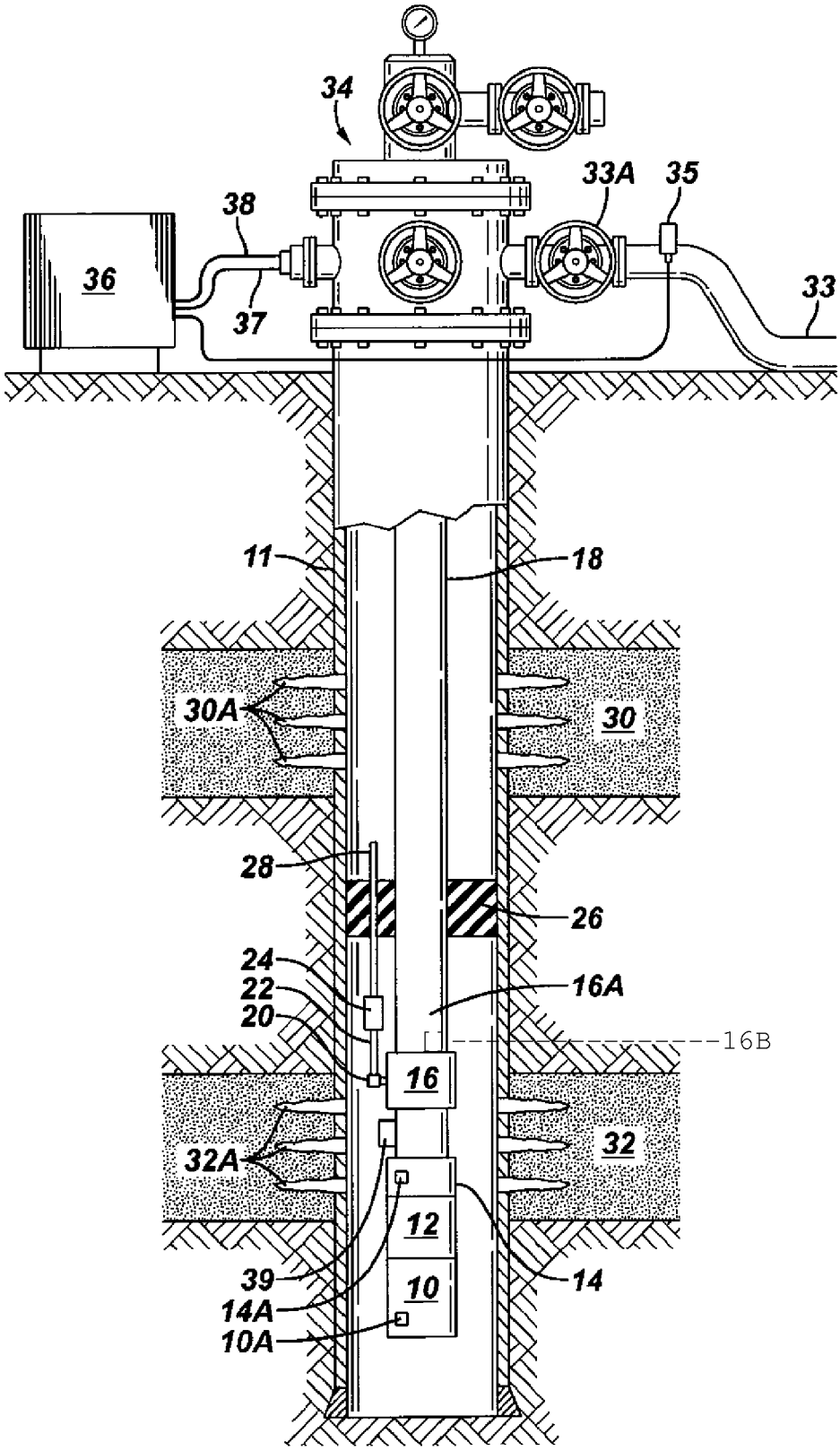
FIG. 1 shows a schematic representation of one example of a pump/separator system according to the invention disposed in a wellbore.

A schematic representation of an example production system including an electric submersible pump ("ESP") coupled to a downhole oil water separator ("DOWS") is shown in FIG. 1. A wellbore drilled through subsurface formations, including an oil producing formation 32 and a water disposal or "injection" formation 30, has a pipe or casing 11 extending from a wellhead 34 at the Earth's surface to the bottom of the wellbore. The casing 11 is typically cemented in place to hydraulically isolate the various subsurface formations and to provide mechanical integrity to the wellbore.

A production system including an ESP is disposed inside the casing 11 at a selected depth. The ESP typically includes an electric motor 10 such as a three-phase AC motor coupled to a protector 12. A motor sensor 10A that may include sensing elements (not shown separately) such as a three axis accelerometer may detect vibration generated by the motor 10. Measurements of acceleration (vibration) may be transmitted to the Earth's surface to provide information about the operating condition of the motor 10. The motor sensor 10A may also include a current measurement sensing elements (not shown separately), measurements from which may also be transmitted to the Earth's surface and used to provide information about the operating condition of the motor 10. The motor sensor 10A may also include a pressure transducer (not shown separately) to measure fluid pressure inside the casing 11.

Rotational output of the motor 10 is coupled, through the protector 12, to a centrifugal pump 14. The intake of the pump 14 is in hydraulic communication with the interior of the casing 11 so that fluid entering the casing 11 through perforations 32A located opposite the producing formation 32 will be drawn into the pump intake and lifted by the pump 14 toward the Earth's surface. A pressure sensor 14A may be disposed proximate the pump intake to measure fluid pressure. The purpose for such fluid pressure measurements will be further explained below.

The pump 14 discharge can be coupled to the intake of a DOWS 16. The DOWS 16 in this example may be a centrifuge type separator. A rotor (not shown separately) in the interior of the DOWS 16 may be rotated by the motor 10 to cause the fluid moved therein by the pump 14 to rotate at high speed, thus causing separation of oil from water in the fluid pumped therein from the interior of the casing 11. Hydrocyclone type separators may be used in other examples, and so the use of a centrifuge type DOWS in the present example is not intended to limit the scope of the invention. The DOWS 16 includes an oil outlet 16A disposed generally at the radial center thereof. The DOWS 16 also includes a water outlet 22 disposed generally near the radial edge of the DOWS 16.

The oil outlet 16A is coupled to production tubing 18 that extends to the wellhead 34 at the Earth's surface. Thus, all fluid moved into the production tubing 18 from the oil outlet 16A is moved to the Earth's surface. The production tubing 18 passes through an annular sealing element called a packer 26 disposed generally above the producing formation 32 and below the injection formation 30. The packer 26 cooperatively engages the exterior of the tubing 18 and the interior of the casing 11 to hydraulically isolate the producing formation 32 from the injection formation 30, among other purposes.

It will be readily appreciated by those skilled in the art that the configuration shown in FIG. 1, wherein the injection formation 30 is located above the producing formation 32 is not the only configuration for which an ESP/DOWS system may be used. In other examples, the producing formation may be located above the injection formation. In such configurations, the location of sealing element (packers) may be different, and the water outlet may be directed downward rather than upward as shown in FIG. 1, however the principle of operation of the system in such configurations is the same as that shown in FIG. 1. Accordingly, the relative depths of producing and injection formations is not a limit on the scope of this invention.

The water outlet 22 may be functionally coupled to a flowmeter and/or pressure sensor shown generally at 20, such that the fluid pressure and/or flow rate in the water outlet 22 can be determined. The purpose for such sensors and measurements will be further explained below. Downstream from the flowmeter and pressure sensor 20 is a control valve 24. The control valve 24 can controllably restrict or stop the flow from the water outlet 22. The outlet of the control valve 24 is coupled to an injection line 28. The injection line 28 may pass through a suitable sealed feed through opening in the packer 26 and can terminate inside the casing 11 above the packer 26.

In some examples, the sensor 20 may include an oil in water ("OIW") sensing element (not shown separately. The OIW sensing element may be, for example, a photoacoustic sensor, an ultrasonic particle monitor, a fiber optic fluorescence probe or an infrared sensor, or combinations of the foregoing. As will be further explained below, if the sensor 20 detects any amounts of oil in the water being returned to the injection formation, the control valve 24 may be closed or the DOWS rotational speed may be controlled to reduce or eliminate such oil.

The injection formation 30 is disposed above the packer 26 in this example, and is in hydraulic communication with the interior of the casing by perforations 30A. Thus, the injection line 28 outlet is in hydraulic communication with the injection formation 30, and is hydraulically isolated from the producing formation 32. The control valve 24 may be hydraulically actuated from the Earth's surface using a hydraulic line 38 as will be further explained below with reference to FIG. 3. Hydraulically actuated valves for use in wellbores are known in the art. See, for example, U.S. Pat. No. 6,513,594 issued to McCalvin et al. and assigned to the assignee of the present invention. It should be understood that the control valve 24 is not limited to hydraulic actuation as shown in FIG. 1. Electric and pneumatic actuation, as two other non-limiting examples, can also be used with this invention. When the control valve 24 is fully closed, the entire output of the DOWS 16 is constrained to flow through the oil outlet 16A, up the tubing 18 to the Earth's surface.

A pressure sensor and/or flowmeter, shown generally at 35 may be installed in a flow line 33 at the Earth's surface. The flow line 33 is hydraulically coupled to the tubing 18, typically through a "wing" valve 33A disposed proximate the wellhead 34. The flow line thus acts as a discharge or outlet from the wellbore. Alternatively, the sensor 35 may be installed at the base of the production tubing 18 (at the oil outlet 16A). In some implementations, the sensor 35 may include a solids in water sensor such as an ultrasonic particle monitor. In some examples, as will be explained below, the amount of fluid discharged from the well may be controlled to reduce or eliminate any solids determined to be present in the produced fluid entering the base of the tubing 18.

Measurements from the various sensors 20, 14A and 10A disposed inside the wellbore may be communicated to a data acquisition and telemetry transceiver 39. The telemetry transceiver 39 formats the signals from the various sensors into a suitable telemetry scheme for communication to the Earth's surface, typically along the power cable 37 used to provide electric power to operate the motor 10. The telemetry signals are communicated to a power/data acquisition and control unit 36 disposed at the Earth's surface generally near the wellhead 34. Signals from the flowmeter/pressure sensor 35 in the flowline 33 or other sensor at the Earth's surface may also be communicated to the control unit 36 as shown in FIG. 1. Operation of the power/data acquisition and control unit 36 in response to the various measurements will be further explained below.

The configuration shown in FIG. 1 contemplates having system control functions, to be explained further below, performed by certain system components located at the Earth's surface, specifically, in the control unit 36. It expressly within the scope of this invention that the described control functions could also be performed by suitable and/or comparable system control devices (to be further explained with reference to FIG. 3) disposed in the wellbore. Accordingly, the location of the system control devices shown and described herein is not a limit on the scope of this invention.

Figure 2:
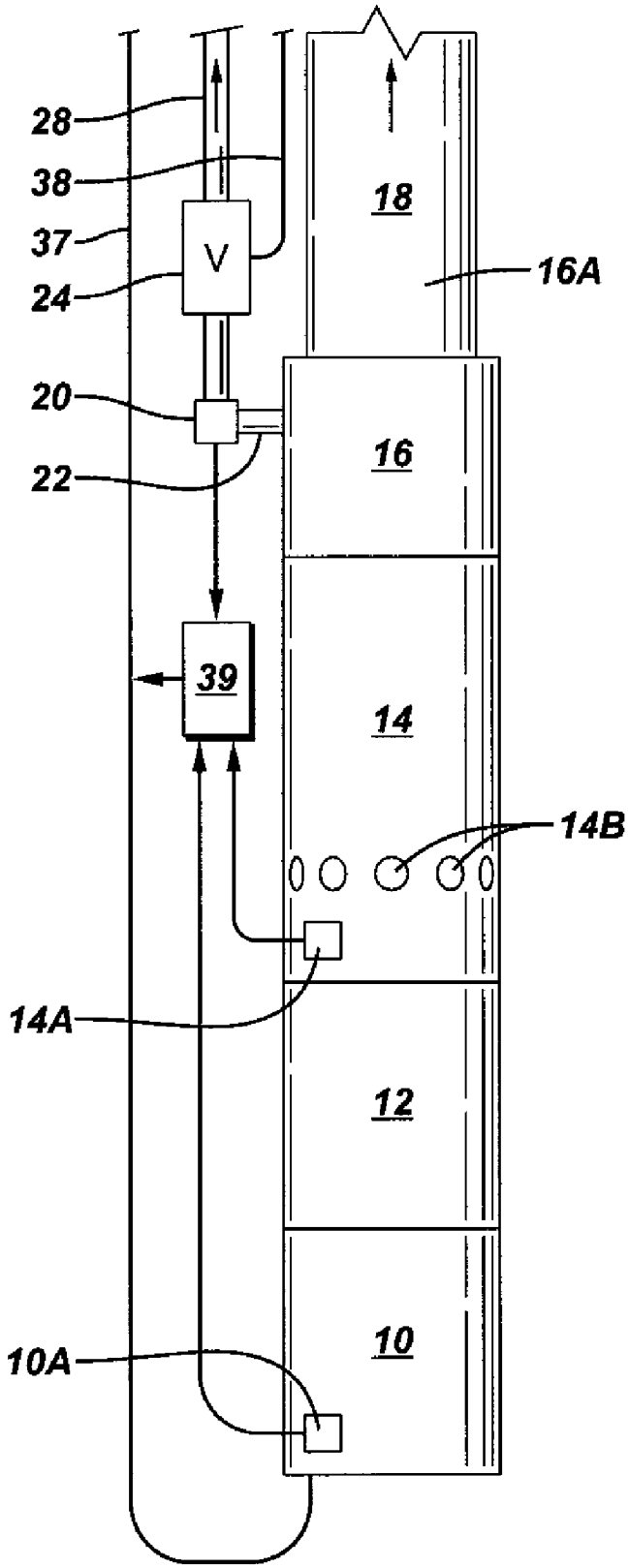
FIG. 2 shows the example system of FIG. 1 in more detail.

FIG. 2 shows in more detail the production system components that are generally coupled to the lower end of the production tubing 18. The oil outlet 16A of the DOWS 16 is shown coupled to the lower end of the tubing 18, such that all fluid leaving the oil outlet 16A moves up the tubing 18. The pump 14 is shown coupled to the intake side of the DOWS 16. The motor 10 and protector 12 are also shown in their ordinary respective positions in the system. The pressure sensor 14A is shown proximate the intake 14B of the pump 14 to measure the fluid pressure at the intake 14B as previously explained. The flowmeter/pressure sensor 20 functionally coupled to the water outlet 22 are also shown.

The control valve 24 and valve actuator control line 38 are shown disposed downstream of the flowmeter/pressure sensor 20. Outlet 28 of the control valve 24 is also shown. Finally, signal connections from each of the sensors 10A, 14A, 20 are shown coupled to the data acquisition/telemetry transceiver 39. Signal output from the transceiver 39 is coupled to the power cable 37.

Figure 3:
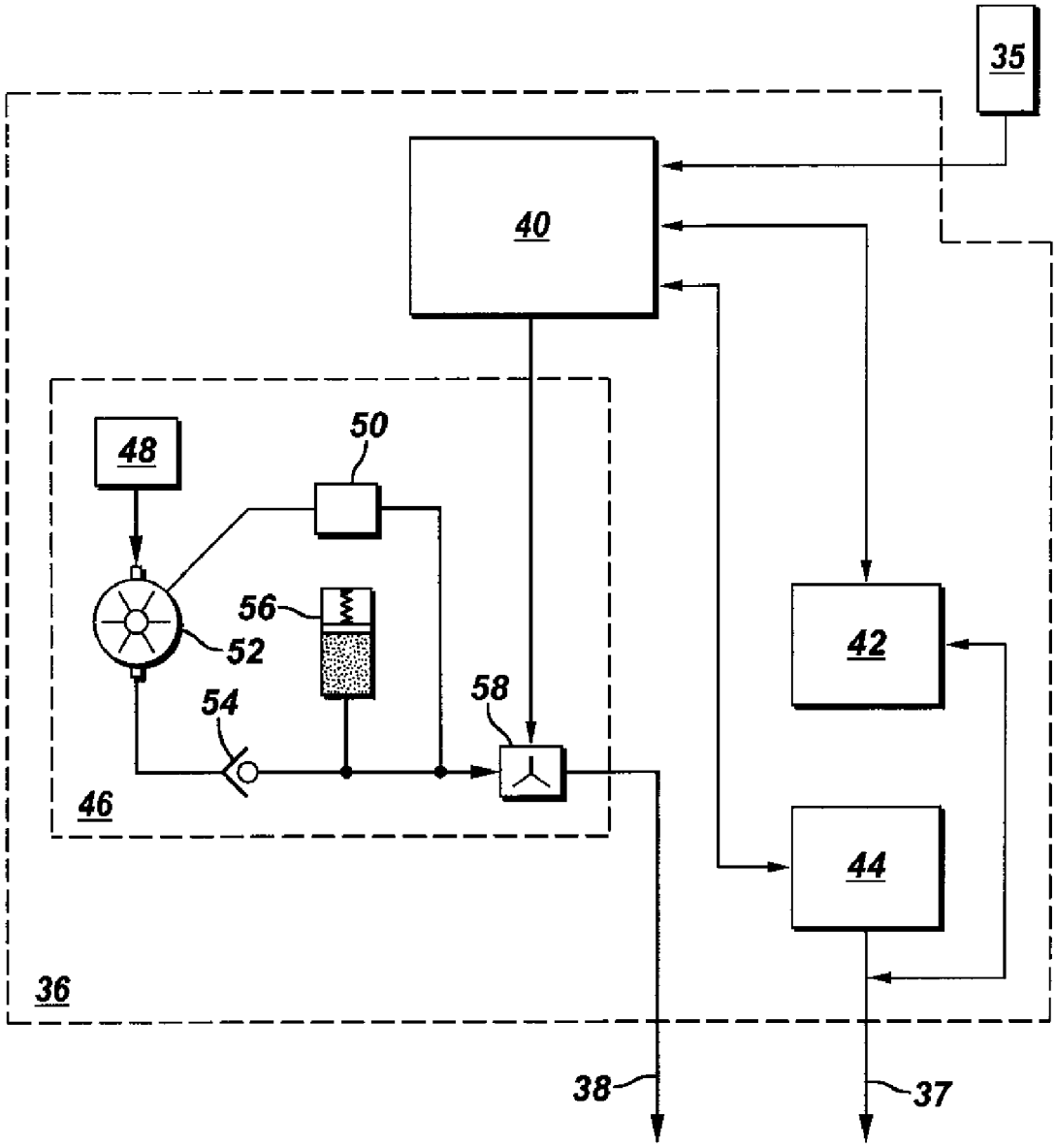
FIG. 3 shows a schematic diagram of one example of a surface data acquisition/power and control unit.

FIG. 3 shows a schematic diagram of one example of systems in the power/data acquisition and control unit 36. The control unit 36 may include a telemetry transceiver 42 that can receive and decode telemetry from the telemetry signals transmitted along the power cable 37. Decoded telemetry, representing measurements from the various sensors explained above with reference to FIGS. 1 and 2 may be communicated to a central processor ("CPU") 40. The CPU may be any microprocessor based controller or programmable logic controller, such as one sold under the trademark FANUC, which is a trademark of General Electric Corp., Fairfield, Conn. A control output of the CPU 40 may be coupled to a motor speed controller 44 of any type known in the art, such as an AC motor speed controller. The AC motor speed controller 44 may be operated by the CPU 40 to cause the motor (10 in FIG. 1) and thus the pump (14 in FIG. 1) and DOWS (16 in FIG. 1) to operate at a selected rotational speed. Another control output of the CPU 40 may be coupled to an actuator control 46. The actuator control 46 provides hydraulic pressure to operate the control valve (24 in FIG. 1). Components of a typical actuator control may include a hydraulic pump 52, the inlet of which is coupled to a reservoir 48 of hydraulic fluid. Discharge from the pump passes through a check valve 54 and charges an accumulator 56 configured to maintain a selected system fluid pressure. A pressure switch 50 may stop the pump when the selected system pressure is reached. Hydraulic pressure may be selectively applied to the hydraulic line through a throttling valve 58. The throttling valve may be an electric over hydraulic operated valve coupled to the control output of the CPU 40. Thus, the CPU 40 may be programmed to select both the motor speed and the degree to which the control valve (24 in FIG. 1) is opened.

Having explained components of a production system that can be used in accordance with the invention, examples of operation of the pump (14 in FIG. 1) and control valve (24 in FIG. 1) to effect particular operation of the DOWS (16 in FIG. 1) will now be explained.

A first procedure that may be programmed into the CPU 40 is a "start up" procedure. Start up refers to initiating operation of the motor (10 in FIG. 1), pump (14 in FIG. 1) and DOWS (16 in FIG. 1) after a period of inactivity thereof. During such inactive periods, the fluid entering the casing (11 in FIG. 1) from the producing formation (32 in FIG. 1) will tend to rise to a level therein such that its hydrostatic head equals the fluid pressure in the producing formation. At the same time, oil in the fluid in the casing (11 in FIG. 1) will tend to separate from the water in the fluid. After such separation, the pump intake may be submerged entirely in oil, rather than in a combination of water and oil as the fluid enters from the producing formation (32 in FIG. 1). Thus submerged, the fluid discharged from the pump and entering the DOWS (16 in FIG. 1) will initially be composed entirely of oil. If oil alone is passed through the DOWS, oil will be discharged at the water outlet (22 in FIG. 1). Thus, initially, if the system were otherwise uncontrolled, oil would be injected into the injection formation (30 in FIG. 1) until a substantial amount of water became present at the pump intake. In the present example, the CPU 40 may be programmed at start up to operate the throttling valve 58 to provide hydraulic pressure to close the control valve (24 in FIG. 1). Thus, all the fluid leaving the DOWS 16 will be produced up the tubing (18 in FIG. 1). The CPU 40 may be programmed to keep the control valve closed until which time as the pressure measured at the pump intake (by pressure sensor 14A in FIG. 1) or at the bottom of the motor (by sensor 10A in FIG. 1) drops to a predetermined level. At such time, the pump intake will be exposed to a suitable combination of water and oil. The water outlet of the DOWS would then discharge substantially all water, as is the designed purpose of the DOWS. The CPU 40 may then operate throttling valve 58 to open the control valve (24 in FIG. 1). Thus, water being discharged from the water outlet (22 in FIG. 1) may freely pass to the injection formation (30 in FIG. 1).

Another example procedure includes measuring pressure and flow rate at the water outlet (22 in FIG. 1) using the flowmeter/pressure sensor (20 in FIG. 1) during operation of the ESP and DOWS. If during operation the flow rate through the water outlet or the pressure in the water outlet change materially, then the CPU 40 may operate the throttling valve 58 to cause the control valve to partially or totally close. In another example, the CPU 40 may use measurements of flow rate through the water outlet (22 in FIG. 1) to operate the control valve (24 in FIG. 1) such that a selected water flow rate into the injection formation is maintained. In another example, the CPU 40 may be programmed to operate the throttling valve (and consequently the control valve) such that a selected pressure is maintained in the water outlet.

In another example, measurements from the flowmeter/pressure sensor in the flowline (sensor 35 in FIG. 1) may be used by the CPU 40 to control the motor speed (and consequently the pumping rate of the ESP) and the control valve aperture so as to optimize operation of both the ESP and the DOWS. Optimization can include, for example, maintaining a selected fluid flow rate at the Earth's surface, and maintaining a selected water flow rate into the injection formation (30 in FIG. 1). By optimizing the operation of the ESP and the DOWS, unintended injection of oil into the injection formation can be avoided, while the ESP may be operated to lift a predetermined amount of fluid (oil and/or oil water combination) to the Earth's surface.

In still other examples, and as explained above, if an oil in water sensor is included in the water injection line, the CPU may be programmed to restrict or shut the control valve (24 in FIG. 1) in the event any significant quantity of oil is determined to be present in the water to be injected. If a solids in water sensor (16B in FIG. 1) is included in the oil outlet (16A in FIG. 1), the CPU may be programmed to reduce the motor speed in the event solids are determined to be present in the produced fluid stream. Alternatively, the signals generated by the oil in water and solids in water sensors may be communicated to the Earth's surface using telemetry as previously explained. A system operator may observe the amounts of oil and/or solids detected by the respective sensors and may manually adjust the motor speed and/or control valve position to correct any improper operation of the production system.

Returning to FIG. 2, vibration and current measurements made, for example, by the sensor 10A on the motor 10 may be used by the CPU (40 in FIG. 3) to determine the existence of problems with the motor 10 or the pump 14.

A system according to the various aspects of the invention may provide better control over subsurface water separation and disposal, and more efficient operation of an ESP.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for operating a downhole oil water separator and an electric submersible pump in a wellbore, comprising:

starting the pump;

measuring fluid pressure proximate at least one of an intake of the pump, a bottom of the wellbore and an intake of the separator; and stopping flow from a water outlet of the separator until the fluid pressure reaches a selected value.

2. The method of claim 1 further comprising measuring at least one of pressure and flow rate at a the water outlet and controlling a restriction in the water outlet to maintain at least one of a selected pressure and a selected flow rate of water into an injection formation.

3. The method of claim 1 further comprising measuring at least one of pressure and flow rate out of the wellbore, and controlling a speed of the pump to maintain at least one of selected fluid pressure and a selected flow rate in fluid discharging from the wellbore.

* * * * *